United States Patent [19]

Murata et al.

[11] Patent Number: 4,616,946

[45] Date of Patent: Oct. 14, 1986

[54] PRINTING DEVICE HAVING EXTERNAL DATA INPUT

[75] Inventors: Mitsuru Murata, Shizuoka; Toyohiro Kobayashi, Yaizu; Shoji Mochizuki; Masamichi Kawashima, both of Shizuoka, all of Japan

[73] Assignee: Mitsubishi Denki Kabushiki Kaisha, Tokyo, Japan

[21] Appl. No.: 680,499

[22] Filed: Dec. 11, 1984

[30] Foreign Application Priority Data

Apr. 27, 1984 [JP] Japan ..... 59-85519
Jun. 1, 1984 [JP] Japan ..... 59-112791

[51] Int. Cl.[4] ..... B41J 5/30; B41J 3/42

[52] U.S. Cl. ..... 400/704; 400/61; 400/74

[58] Field of Search ..... 400/61, 74, 704, 62, 400/66, 703; 371/20

[56] References Cited

U.S. PATENT DOCUMENTS 3,987,420 10/1976 Badagnani ..... 364/200
4,323,315 4/1982 Demonte et al. ..... 400/63
4,339,801 7/1982 Hosaka ..... 371/20 X
4,497,589 2/1985 Figini ..... 400/61 X

FOREIGN PATENT DOCUMENTS 160670 10/1982 Japan ..... 400/70
2021833 12/1979 United Kingdom ..... 400/76

OTHER PUBLICATIONS

*IBM Tech. Disc. Bulletin*, by J. I. Compton, vol. 25, No. 6, Nov. 1982, pp. 2776, 400–704.

*Primary Examiner*—Paul T. Sewell
*Attorney, Agent, or Firm*—Oblon, Fisher, Spivak, McClelland & Maier

[57] ABSTRACT

A printing device of a construction wherein operation checking program data for checking various operations of a printing mechanism and a display unit are memorized in a memory unit, into which print data for editing, memory, correction of sentences, etc. are memorized, and, on the basis of the operation checking program data, the printing mechanism and the display unit are caused to perform predetermined operations to effect the operation checking. In the above-described memory unit, not only the checking program data, but also the print completion of the memory operation of which the printing operations can be effected.

8 Claims, 8 Drawing Figures

PRINTING DEVICE HAVING EXTERNAL DATA INPUT

BACKGROUND OF THE INVENTION

Field of the Invention

This invention relates to an electronic typewriter which is controlled by a micro-computer, and, more particularly, it is concerned with a mechanism for checking operations to be conducted at the time of assembly of the above-mentioned electronic typewriter.

FIG. 1 of the accompanying drawing illustrates an external appearance of an electronic typewriter which is in general use. In this Figure of drawing, a reference numeral 1 designates a keyboard as a key input means; a numeral 2 refers to a display unit as a display means for displaying therein print data from the above-mentioned keyboard; and a numeral 3 refers to a printing unit as a printing means for printing the contents displayed in the above-mentioned display unit. Also, in the interior of the above-mentioned electronic typewriter, there are incorporated an editing memory which memorizes, edits, and corrects the print data; a micro-computer as the control means; and so forth. Each and every unit in the electronic typewriter is controlled by this micro-computer. On the other hand, as the general checking items, when assembling the above-mentioned electronic typewriter, there may be contemplated the following: (1) whether the keyboard 1 is capable of performing its regular input operations, or not; (2) whether the display unit 2 performs its regular operations, or not; (3) whether the printing unit 3 performs its regular operations, or not; and so forth. However, considerable time and labour must be expended in carrying out these checkings through manual keyboard operations, which inevitably reflects an increase in manufacturing cost. In order therefore to save time and labour, such checking operations have previously been conducted with the help of an automatic checking sequence to be described in the following. That is to say, at the time of manufacturing the electronic typewriter, a checking program to cause certain definite operations to be done at predetermined sections such as the display unit, the printing unit, etc. is first stored in the program ROM within the main body of the electronic typewriter so as to enable the above-mentioned checking program to be actuated when a particular key is pushed during closure of the power source, thereby carrying out the checking operations to find out whether the definite operations are being done at the above-mentioned predetermined sections, or not. Moreover, since this checking program remains in the program ROM of the finished product, it has so far been the practice that the contents of the checking which should not be effected by users are made inactuable directly from outside by providing checking electrodes on the printed circuit wiring board in the main body of the electronic typewriter to short-circuit the electrodes or to vary a voltage level so as to actuate the checking program. In the above-described conventional method, however, the more functions the electronic typewriter possesses and the more complicated the contents of checking become the larger becomes the scale of the checking program with the consequence that a program ROM of a large capacity is needed. However, since the above-mentioned checking program itself is not used in the ultimate product, the program ROM to store therein the checking program becomes wasteful. Furthermore, in the conventional method of actuating the contents of the checking program which should not be effected by the users, there has been such a problem that no checking could be done at all in the state of the product having been assembled. Further, according to the above-mentioned conventional example, the program ROM is a mask ROM made by writing the program therein at the time of manufacturing the ROM for the purpose of reducing its manufacturing cost at the time of mass production in an industrialized scale of the product, hence the contents of the checking program cannot be changed.

SUMMARY OF THE INVENTION

The present invention is provided with the checking operation control means in which the checking program data are input from outside, then the data are stored in the memory for memorizing sentences, etc., and the printing unit such as the electronic typewriter, etc. is caused to perform certain definite operations on the basis of the above-mentioned checking program.

In this way, the checking program can be handled in a fairly large scale without use of the program ROM within the main body of the electronic typewriter, etc. In addition, the checking operations become possible in the finished state of the product, and the contents of the checking program can also be changed easily. Further, since no checking program remain within the main body, there is no possibility of the contents of the checking operations being made known to the users, and various other practical effects.

Moreover, in the electronic typewriter having a function as the printer for an external device, an external interface and a connector, which have already been installed, can be used by separately providing a discriminating means which makes distinction between the checking program data and the print data, hence the checking operation can be done more easily.

According to another embodiment of the present invention, as the device is of such a construction that a storage section to store and accumulate therein external data is provided in the memory means to memorize therein the key input data, and that the control means drives the printing mechanism on the basis of these stored external data, the external devices such as personal computers, etc. which produce those external data outputs can be used for other purposes without such external devices being used exclusively for printing. In addition, since a changeover means is provided for enabling the external data to be changed over to either the above-mentioned memory means or the printing mechanism, it becomes possible not to erase the key input data as memorized in the memory means, depending on necessity.

BRIEF DESCRIPTION OF THE DRAWINGS

One way of carrying out the invention is described in detail below with reference to drawings which illustrate a few specific embodiments, in which.

DETAILED DESCRIPTION OF THE PREFERRED EMBODIMENTS

Figure 1:
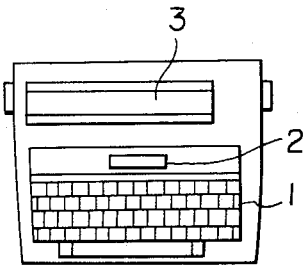
FIG. 1 is a top plan view showing external appearance of an electronic typewriter.
Figure 2:
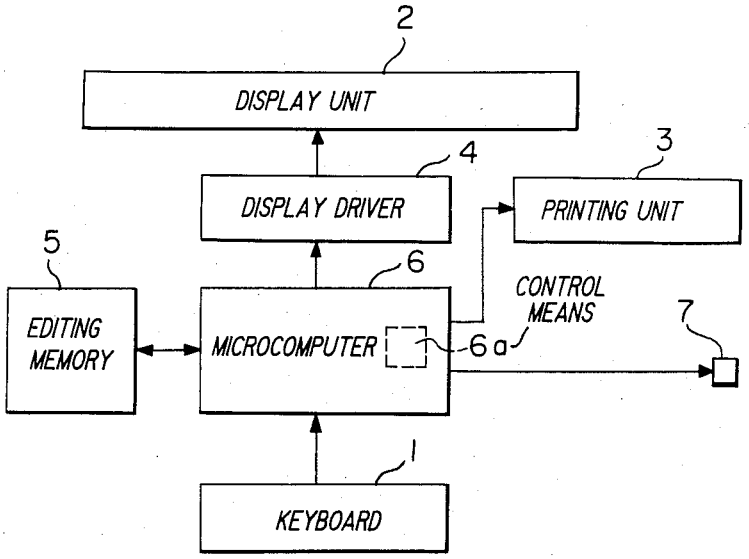
FIG. 2 is a block diagram showing an electrical control section in one embodiment of the electronic typewriter according to the present invention.

FIG. 2 is a block diagram showing one embodiment of the electronic typewriter according to the present invention. In the drawing, a reference numeral 1 designates a keyboard; a numeral 2 refers to a display unit; and 3 indicates a printing unit, all of which are the identical parts as designated by the same reference numerals in FIG. 1. A numeral 4 refers to a display driver for driving the display unit 2; a reference numeral 5 designates an editing memory to perform editing, memory, correction, etc. of sentences, having the function of a word processor for the printing device according to the present invention; and a numeral 6 refers to a micro-computer as the control means for controlling the above-mentioned parts of the device according to the present invention. In this embodiment, a checking operation control means *6a* is provided in the above-mentioned micro-computer 6, which controls the checking operations in accordance with the input checking program from an external unit. Incidentally, for input of the checking program data from the external unit, there is used an input/output port of the micro-computer 6, the input of which is effected through a connector 7 specially provided on the face of the outside of the main body. The above-mentioned connector 7 is provided at one part of the bottom surface of the main body, which can be easily installed and covered by use of threaded screws so that users may not touch it after completion of the checking operations.

Figure 3:
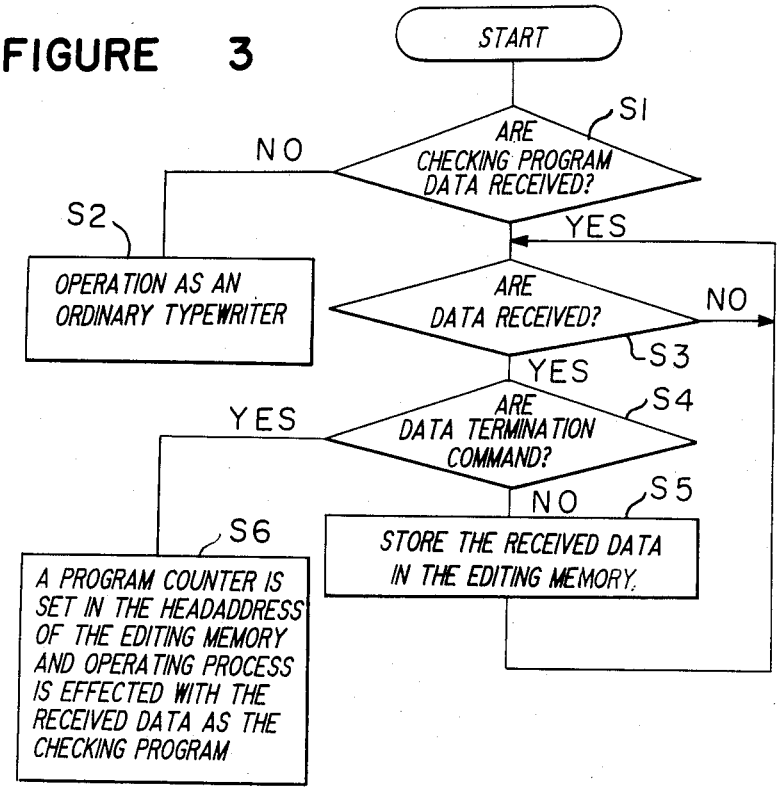
FIG. 3 is a flow chart showing the checking operations of the above-mentioned embodiment.

In the following, explanations will be given in reference to the flow chart shown in FIG. 3 as to the checking operations by the embodiment of the printing device of the above-described construction. First of all, judgement is made at the step S1 as to whether the checking program data have been received into the input/output port of the micro-computer 6, through the connector 7 specially provided in the electronic typewriter, from an external unit for sending out the checking program data, or not. If the data have not been received, the operational sequence proceeds to the step S2 where the printing device is used as an ordinary typewriter. At the step S1, if the checking program data have been received, the operational sequence proceeds to the step S3 to wait for input of the checking program data. As soon as the data are input, judgement is made at the step S4 as to whether the data are the termination command, or not. If the data are not the termination command, the sequence proceeds to the step S5 where the above-mentioned data are stored in the editing memory 5. The above-mentioned steps S3 to S5 are repeatedly peformed to thereby sequentially store the checking program data into the editing memory 5. When the input checking program data have been completely entered into the editing memory, input data signifying the termination command are finally introduced into the editing memory 5. The input data are judged at the step 4 to be the termination command, and then the sequence proceeds to the step S6. At the step S6, a program counter is set in the head address of the editing memory 5 by the checking operation control means *6a* in the micro-computer 6, and the control is done in such a manner that the operating process may be effected with the above-mentioned received data as the checking program.

Thus, according to this embodiment of the present invention, since the checking program data are input from the external unit and stored in the editing memory 5 constructed with RAM of the elecronic typewriter, and the operating process is controlled by the checking operation control means *6a* in the micro-computer 6, there is no necessity for providing the program ROM for the checking program. Further, since the editing memory 5 has a large capacity, it is possible to handle a checking program of a fairly large scale. Furthermore, with the connector 7 being provided, the product can be inspected in its finished condition. Moreover, since the editing memory 5 is constructed with a RAM which is capable of writing in at any time, the contents of the checking program can be easily changed. In addition, since the checking program is erased by turning-off of the power source, there is no possibility of the contents of the checking program being made known to the users.

Figure 4:
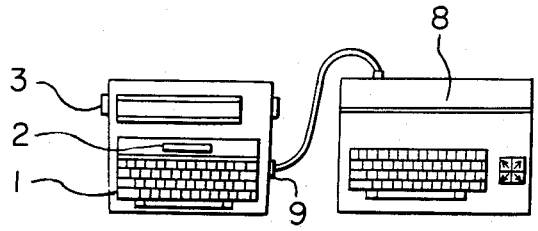
FIG. 4 is a diagram showing a connection of the electronic typewriter with an external unit according to another embodiment of the present invention.
Figure 5:
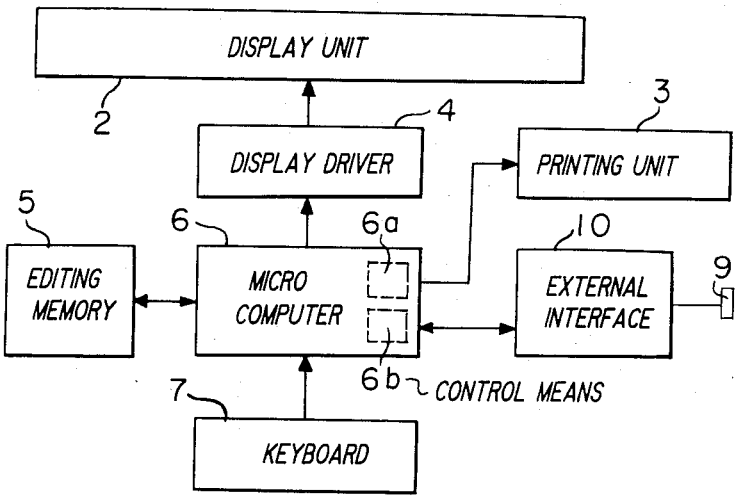
FIG. 5 is a block diagram of the electrical control section in the electronic typewriter according to the embodiment shown in FIG. 4.
Figure 6:
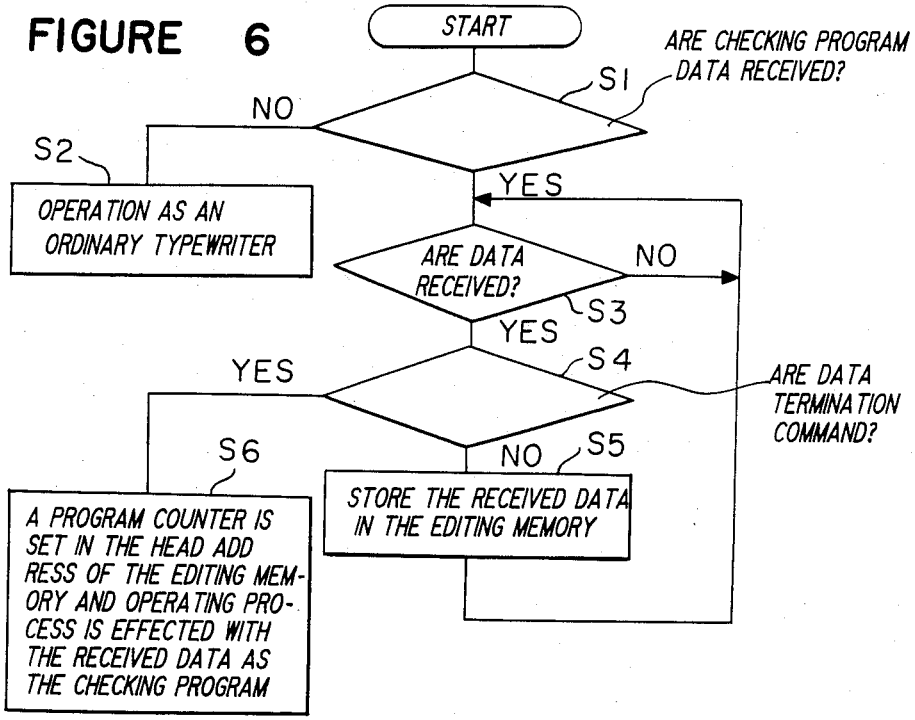
FIG. 6 is a flow chart showing the operation of the electronic typewriter according to the embodiment shown in FIG. 4.

In the following, explanations will be given in reference to FIGS. 4 to 6 as to another embodiment of the printing device according to the present invention. In the above-described first embodiment, explanations have been made as to a case, wherein the present invention has been put into practice on an electronic typewriter having only the conventional functions such as the word processor function, and others. However, the present invention can also be applied to an electronic typewriter which is operated as a printer, wherein, as shown in FIGS. 4 and 5, input data are introduced from an external unit 8 such as a personal computer, etc. through a connector 9 as an input terminal provided at the lateral side of the device main body. In FIGS. 4 and 5, an external interface 10 is interposed between the micro-computer 6 and the connector 9 provided at the lateral side of the device main body. The external interface 10 is to perform adjustments of the form, the transfer speed, and so on of the checking program data at the time of their input into and output from the external unit 8. The printing device according to the present invention is adapted to be usable as the printer by outputting the print data from the external unit 8 into the printing unit 3 through the micro-computer 6 by way of the external interface 10. On the other hand, this second embodiment of the device according to the present invention incorporates a discriminating means *6b* in the micro-computer 6, in addition to the checking operation control means *6a*, with which discrimination is done between the cases of the present device being used as the printer and of its being used for the checking operations.

The above-mentioned discrimination can be effected by various methods such as, for example, whether a particular key has been depressed, or not, when the power source is turned on; whether the data received by use of the contents of the received data are of particular patterns, or not; and so forth. In such construction, the checking operations according to this second embodiment are carried out in accordance with the flow chart shown in FIG. 6. Incidentally, the steps S3 to S6 are identical with those in the afore-described first embodiment shown in FIG. 3. In this second embodiment of the present invention, discrimination is made at the step S1 as to whether the received data which have been input through the connector 9 and the external interface 10 from the external unit 8 such as the personal computer, etc. shown in FIG. 4 are the checking program data or the print data. In case the received data are not the checking program data, the operational sequence proceeds to the step S2 where the signal receiving process and operation of the print data as the printer function are carried out. In case the received data are the checking program data, the operational sequence proceeds to the steps S3 to S6, and the checking operations are carried out. Therefore, in this embodiment, too, the same effect as that in the afore-described embodiment can be obtained. Further, according to this embodiment, as it is possible to use the external interface 10 and the connector 9 in the electronic typewriter having the printer function, the checking operations can be done more easily.

Incidentally, in the printing device having the function of the electronic typewriter having therein the memory RAM for performing memory, editing, and correction of sentences as the word processor function, and the function of the printer which receives print data as the external data from the external unit such as a personal computer, etc. to perform the printing, the memory RAM built therein is used only for storing the sentences when the electronic typewriter function is utilized, and the memory is not used when the printer function of the device is employed.

On account of this, when the printing device is used as the printer, it becomes necessary that the data sent from the external unit such as the personal computer, etc. be processed sequentially as "signal receiving for one character →printing for one character". As the result of this, in spite of the external unit such as the personal computer, etc. being able to transfer the print data at a high speed, such external unit is governed by the printing speed of the printer with the consequence that the external unit is used exclusively for the printing operation to make it impossible to use the device as the electronic typewriter over a long period of time until the printing operation is terminated.

Further, the printing device having both electronic typewriter function and printer function is, in most cases, of the thermal transfer type having a printing head which forms a character by a dot matrix. In this type of the printing device, the number of dots per one character or letter are increased for upgrading of the print letters required of the typewriter function, on account of which a long time is taken for printing one character or letter. As the consequence of this, the device does not satisfy the requirement of high printing speed necessary for the printer. In addition, when the device is used as the printer, the time for exclusive use of the external unit such as the personal computer, etc., during the printing, becomes prolonged, which causes inconvenience on the part of the users.

The above-mentioned problem will be solved by providing, in still other embodiment of the present invention, a storing section to accumulate and store therein external data in the memory means which is to memorize therein key input data introduced from the key input means so that the control means may drive the printing mechanism on the basis of the external data stored in this storing section.

Figure 7:
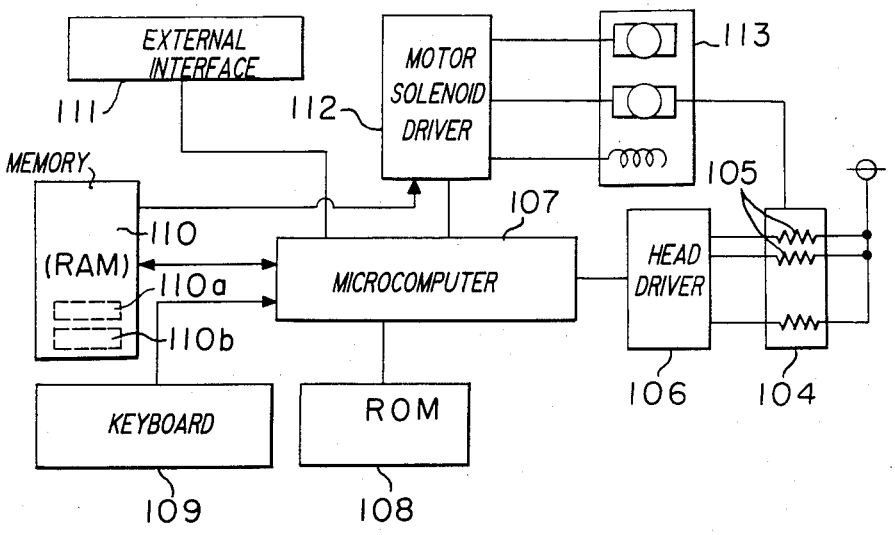
FIG. 7 is a block diagram showing a construction of the electrical control circuit in a heat-transfer type electronic printing device, in particular.

In the following, the present invention will be explained with reference to still another embodiment thereof shown in FIG. 7. FIG. 7 is a block diagram showing a construction of the printing device, particularly the heat transfer type electronic printing device, in which a reference numeral 104 designates a printing head; a numeral 105 refers to a group of resistive heat generating bodies constituting the printing head; a numeral 106 refers to a head driver for supplying electric power to the printing head 104; a reference numeral 107 indicates a micro-computer which performs control of the printing device according to this embodiment; 108 indicates a ROM for storage of a print character font; 109 an input keyboard as the key input means to be operated by an operator; and 110 a memory RAM as the memory means, which includes data storing sections **110*a* and 110*b*. A reference numeral 111 designates an external interface circuit to effect connection with the external unit such as a personal computer, etc., for which various systems such as the "Centronix" specification, "RS-232C" specification, and so forth may be envisaged. A numeral 112 refers to a driver for a motor solenoid which drives the mechanical parts of the printing device, and a reference numeral 113 designates a motor solenoid for driving the mechanical parts of the printing device. The printing mechanism is constructed with the above-mentioned printing head 104, the head driver 106, the driver 112, and the motor solenoid 113**.

In the following, explanations will be given as to the operations of the printing device of the above-described structure.

First of all, when the printing device of the present invention is used as the electronic typewriter, the character data which have been input by the keyboard 109 of FIG. 7 are stored in the data storing section **110*a* in the memory RAM 110 through the micro-computer 107**. This printing device is capable of performing editing operations such as insertion, deletion, etc. of characters and operators after completion of, or in the course of, the sentence input, the character printing being done upon completion of the edition.

Also, in case the printing device of the present invention is used as the printer, if there is an input from the external interface 111 in FIG. 7, the print data as the external data are temporarily stored at a high speed in the external data storing section **110*b* of the memory RAM 110 through the microcomputer 107**, and, after termination of the data receiving and completion of the accumulation operation, the character printing is effected on the basis of the accumulated data. In this way, there is no need for the external unit such as the personal computer, etc. being exclusively used for the printing purpose, but can also be used for other purposes.

Figure 8:
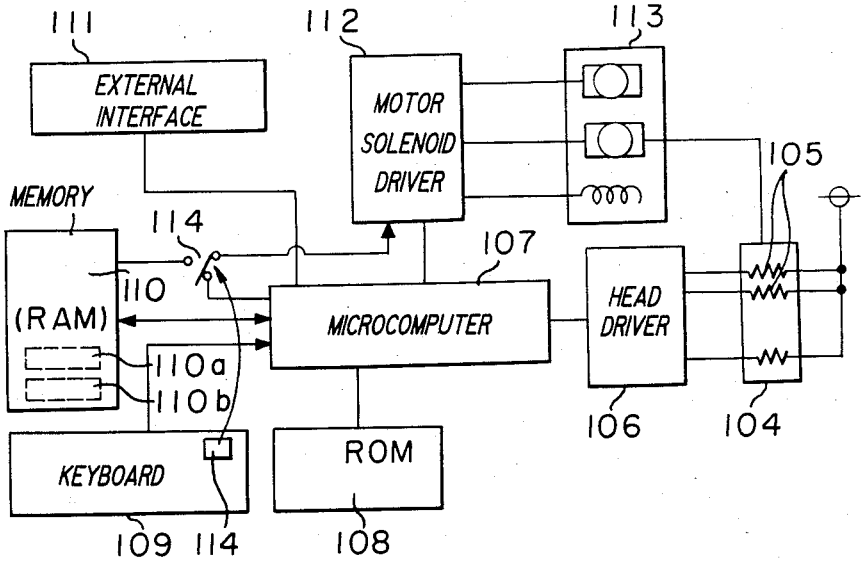
FIG. 8 is a block diagram of still another embodiment of the present invention.

The data stored in the storing section **110*a*, in the case of using the printing device as the electronic typewriter, are erased when it is used as the printer. If, however, it is not desired that the data be erased, a switch 114 may be provided in the keyboard 109 as a change-over means, as shown in FIG. 8, to determine as to whether the memory RAM 110 is rendered a printer buffer, or not, thereby enabling the change-over operation to be done for sending the print data from the micro-computer 107 directly to the motor solenoid driver 112**.

The present invention is not limited to the above-described embodimental construction, but various changes and modifications in designing may, of course, be made without departing from the technical concept of the invention as set forth in the appended claims.

We claim:

1. A printing device functioning as both a typewriter and a printer, comprising:
   - a printing device body;
   - manual print data input means on said body;
   - memory means in said body;
   - printing means on said body;
   - microcomputer control means in said body and operatively connected to said data input means, said memory means and said printing means for controlling the operation thereof;
   - an external data connector at an outer surface of said body and operatively connected to said microcomputer control means;
   - checking operation control means in said microprocessor control means and operatively connected to said external data connector for processing checking program data inputted from said external data connector;
   - an external interface between said external data connector and said microcomputer control mens; and
   - discriminating means in said microprocessor control means for discriminating whether external data from said external data connector is checking program data.

2. Printing device according to claim 1, wherein said microcomputer control means includes means for causing said external data to be memorized in said memory means so as to execute a printer function, when said data have been input through said external interface, and, after completion of the memory operation of said external data, for causing said printing means to commence printing operations.

3. Printing device according to claim 1, further comprising change-over means interposed between said microcomputer control means and said memory means, and between said microcomputer control means and said printing means, for performing switching operations between an operating mode for supplying said external data from said external interface directly into said printing means from said microcomputer control means and an operating mode for storing said external data in said memory means and supplying said external data into said printing means.

4. Printing device according to claim 1, further comprising display means for displaying data on the basis of the print data input from said manual input means, and wherein said microcomputer control means also functions to drive said display means on the basis of said print data.

5. Printing device according to claim 4, wherein said data input through said external interface are checking program data to cause at least said printing means and said display means to perform predetermined operations, said checking program data being stored in said memory means, wherein said microcomputer control means includes means for discriminating whether said checking program data have been input thereinto through said external interface, or not, and, if said checking program data have been input, causing said data to be memorized in said memory means, and, if said checking program data have not been input thereinto, controlling said printing means to function as a typewriter or a printer.

6. Printing device according to claim 5, wherein said microcomputer control means includes means for continuing the storing operation of said checking program data into said memory means, until input data which signify the termination command within said checking program data are entered thereinto.

7. Printing device according to claim 6, wherein said microcomputer control means, has means such that when said storing operation of said operation program data into said memory means has been terminated, the data to be first read out of said checking program data memorized in said memory means is sequentially read out, thereby executing the operation checking with respect to said printing means and said display means.

8. Printing device according to claim 5, wherein said memory means is constructed with a volatile memory, the memorized contents being erased by disconnection of a power source for driving said printing means.

* * * * *